United States Patent [19]

Yamauchi et al.

[11] Patent Number: 4,590,915

[45] Date of Patent: May 27, 1986

[54] MULTI-CYLINDER FUEL ATOMIZER FOR AUTOMOBILES

[75] Inventors: Teruo Yamauchi; Yoshishige Oyama, both of Hitachi, Japan

[73] Assignee: Hitachi, Ltd., Tokyo, Japan

[21] Appl. No.: 670,890

[22] Filed: Nov. 13, 1984

[30] Foreign Application Priority Data

Nov. 10, 1983 [JP] Japan ..... 58-211356

[51] Int. Cl.[4] ..... F02M 29/00

[52] U.S. Cl. ..... 123/590; 123/522; 123/538; 123/478; 261/DIG. 48

[58] Field of Search ..... 123/590, 522, 538, 472, 123/478, 494, 445, 52 M; 261/DIG. 48

[56] References Cited

U.S. PATENT DOCUMENTS 4,105,004 8/1978 Asai ..... 123/590
4,167,158 9/1979 Martin et al. ..... 123/478
4,237,836 12/1980 Tanasawa et al. ..... 123/472
4,251,031 2/1981 Martin ..... 123/538
4,475,486 10/1984 Kessler ..... 123/52 M

FOREIGN PATENT DOCUMENTS 140418 12/1978 Japan ..... 123/590

*Primary Examiner*—E. Rollins Cross
*Attorney, Agent, or Firm*—Antonelli, Terry & Wands

[57] ABSTRACT

A multi-cylinder fuel atomizer for automobiles which includes an electromechanical transducer disposed between a concentrated cylinder arranged in a suction passage and respective suction pipes independently branched from the concentrated cylinder to corresponding cylinders. A horn ring vibrator is fixed to an end of the electromechanical transducer and is partly exposed to the suction pipes. The fuel injector is arranged upstream of the electrical mechanical transducer and is adapted to inject fuel to the horn ring vibrator, with the fuel being atomized by vibrations of the horn ring vibrator.

14 Claims, 26 Drawing Figures

MULTI-CYLINDER FUEL ATOMIZER FOR AUTOMOBILES

BACKGROUND OF THE INVENTION

The present invention relates to a fuel atomizer for automobiles which can cope with fuel supply for multi-fuel and multi-point injection.

Heretofore, fuel supply devices for automobiles have been broadly classified into the two sorts of a carburettor and a fuel injector. The former adopts a continuous fuel measuring system, while the latter an intermittent fuel measuring system, and they are installed on multi-cylinder engines.

With the fuel supply devices, however, the diameters of fuel liquid drops generated are not uniform and very small. Therefore, the uniform distribution of fuel to the respective cylinders of the multicylinder engine cannot be achieved, and fuel to be supplied to the respective cylinders becomes ununiform. The resulting ununiform fuel causes a stable combustion and induces the degradations of an exhaust purification efficiency and a combustion efficiency, which form factors for increasing fuel consumption and a harmful exhaust level. Moreover, in using various sorts of fuel and lowering the grade of fuel recently, the situations cannot be coped with only the fuel supply system based on both the above systems, and a fuel supply system having novel atomization means is eagerly requested.

Meanwhile, from the standpoint of purchasing an automobile, it is desirable that the engine power is high and that the automobile is inexpensive. In this regard, the fuel injector has injection valves for the respective cylinders and employs a suction inertia utilizing arrangement in which a suction pipe is lengthened. Therefore, this system is effective from the viewpoint of enhancing the power, but unfavorably a high cost is incurred on account of a complicated structure. On the other hand, the carburettor system is a system in which fuel measuring portions are concentrated on one point. Although it is simple in arrangement and low in cost, it has the problem that the structure of a suction pipe has a shape incapable of utilizing suction inertia, so the enhancement of power cannot be expected.

For these reasons, there has recently been proposed the technique of atomizing fuel by the use of the ring vibrator of an ultrasonic vibration system as described in the official gazette of Japanese Laid-open Patent Application No. 53-140415. With the ring vibrator, however, the fuel must be concentrated on one point. This leads to the problems that the technique as it is cannot be applied to a multi-point fuel injection type engine, the scope of use thereof being restricted to carburettor type and single-point fuel injection type engines, and that the enhancement of power cannot be expected.

SUMMARY OF THE INVENTION

An object of the present invention is to provide a multi-cylinder fuel atomizer for automobiles which is also applicable to a multi-point injection type engine, and which eliminates astable combustion in respective cylinders even with fuel of low grade and can attain high power with an inexpensive arrangement.

The present invention is so constructed that an electromechanical transducer is disposed between a concentrated cylinder for suction and respective suction pipes, while a horn ring vibrator which is fixed to an end of the electromechanical transducer and which is partly exposed to the respective suction pipes is disposed, fuel being injected to an inner wall of the horn ring vibrator so as to atomize the fuel and then introduce the atomized fuel to respective cylinders.

According to the present invention, the construction specified above brings forth the effects that even the respective cylinders of a multi-point fuel injection type engine can be fed with the atomized fuel without the astable combustion thereof and that high power can be attained with the inexpensive construction. A further effect is that the fuel cost during the idle running of little suction inertia can be reduced.

DETAILED DESCRIPTION OF THE PREFERRED EMBODIMENTS

Now, the present invention will be described in detail in conjunction with embodiments.

Figure 1:
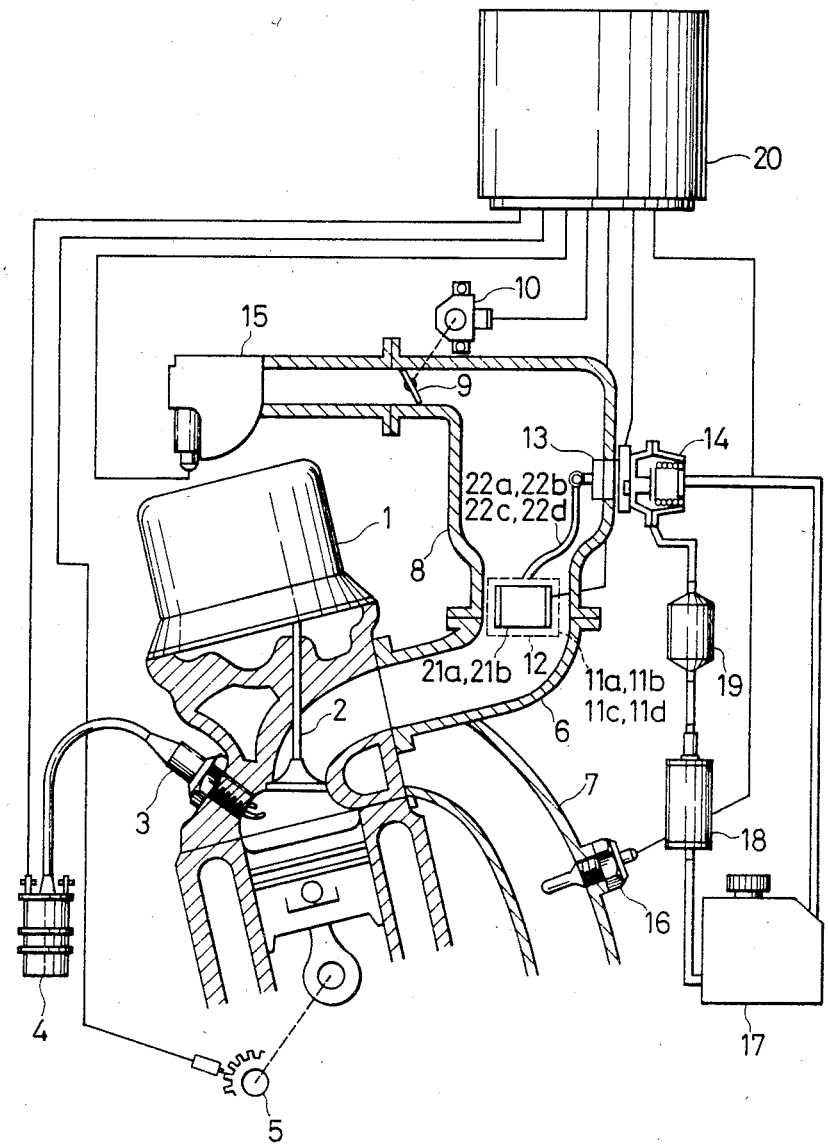
FIG. 1 is a general arrangement view showing an embodiment of an engine system to which the present invention is applied.

FIG. 1 is a general arrangement view showing one embodiment of an engine system to which the present invention is applied.

Referring to the figure, air and fuel are imbibed from a suction pipe 6 by the opening and closure of the suction valve 2 of an engine 1, the mixture is ignited by an ignition plug 3 and burns, and power is transmitted to wheels (not shown). In this case, the ignition plug 3 is constructed so as to generate an electric spark in such a way that the signal of a crank angle sensor 5 is sent to a computer 20 and that a signal is applied to an ignition coil 4 at a necessary timing. Meanwhile, to the end of extending suction inertia, the suction pipe 6 is provided on its upper stream side with a concentrated cylinder 8 which has a volume not smaller than the capacity of one cylinder of the engine 1, and downstream of which independent suction pipes 6*a*, 6*b*, 6*c* and 6*d* are disposed and connected to respectively corresponding cylinders. The control of a suction air quantity for such suction system is executed by controlling the opening of a throttle valve 9. The situation of the throttle valve opening on that occasion is sensed by a throttle valve opening sensor 10, and it is applied to the computer 20 and stored here.

The concentrated cylinder 8 is located downstream of the throttle valve 9, and it is provided on its outlet side with suction pipe ports 11*a*, 11*b*, 11*c* and 11*d* which join to the respective suction pipes 6*a*, 6*b*, 6*c* and 6*d*. An ultrasonic vibrator 12 pertinent to the present invention is inserted in the portion of the suction pipe ports 11*a*, 11*b*, 11*c* and 11*d*.

The ultrasonic vibrator 12 has a structure in which ring vibrators 21*a* and 21*b* are fastened symmetrically with respect to the vibrator. The ring vibrators 21*a* and 21*b* are arranged in such a manner that the respective centers thereof agree with the center of the spacing between the suction pipe ports 11*a* and 11*b* and the center of the spacing between the suction pipe ports 11*c* and 11*d*. Upstream of the ultrasonic vibrator 12, a fuel injection valve 13 is mounted through the sideward outer wall of the concentrated cylinder 8. Fuel distribution nozzles constructed of tubules 22*a*, 22*b*, 22*c* and 22*d* are mounted on the fore end of the injection valve 13, and the fore ends of these nozzles 22*a*, 22*b*, 22*c* and 22*d* are arranged near the ring portions of the ring vibrators 21*a* and 21*b*. A fuel pressure regulator 14 is disposed unitarily with the injection valve 13. Fuel imbibed from a fuel tank 17 is introduced into the regulator 14 through a pump 18 as well as a fuel filter 19 and is regulated into a predetermined pressure. The pressure-regulated fuel is fed to the nozzles 22*a*, 22*b*, 22*c* and 22*d*, while surplus fuel is fed back to the fuel tank 17. An air quantity sensor 15 for measuring the quantity of air (which may be of any of the movable vane type, the hot wire type and the Karman vortex type) is mounted upstream of the throttle valve 9, and its output is sent to the computer 20 and is used for controlling the fuel injection timing and injection time period. Meanwhile, the combustion gas produced by the combustion passes through an exhaust pipe 7 and has the concentration of the residual oxygen thereof sensed by an oxygen sensor 16, whereupon it is emitted into the atmosphere through a catalyst as well as a muffler (not shown). The oxygen sensor 16 has the property that its output signal changes depending upon the surplus oxygen concentration of the exhaust gas. By utilizing this property, the concentration of the mixture imbibed by the engine 1 is presumed, and the valve opening duration of the injection valve 13 is controlled so as to secure fuel economy and exhaust purification as predetermined.

Here, the details of the structure in which the ultrasonic vibrator 12 is fixed by holding the ring vibrator portions in agreement with the suction pipe ports 11*a*, 11*b*, 11*c* and 11*d* will be described with reference to FIG. 2.

Figure 2:
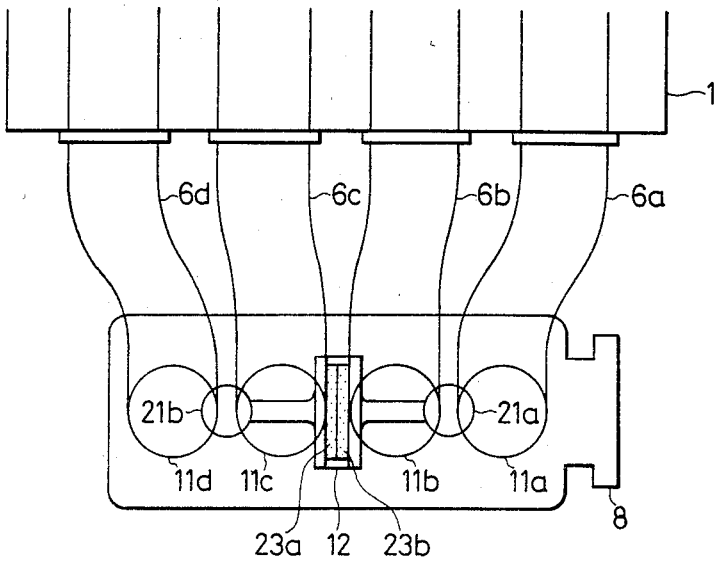
FIG. 2 is a view showing an example of the arrangement of ring vibrators which are installed in a suction pipe.

FIG. 2 shows the horizontal section of the concentrated cylinder 8 seen from the suction upper-stream side and taken horizontally. The concentrated cylinder 8 is provided with the four suction pipe ports 11*a*, 11*b*, 11*c* and 11*d* which are arrayed in series, and which are coupled to the respectively corresponding cylinders of the engine 1 through the independent pipes of the suction pipes 6*a*, 6*b*, 6*c* and 6*d*. The elements 23*a* and 23*b* of the ultrasonic vibrator 12 are disposed so as to lie in contact with the middle wall portion between the suction pipe ports 11*b* and 11*c*. The ring vibrators 21*a* and 21*b* coupled to these elements 23*a* and 23*b* are arranged so as to afford equal projection sections while extending over the suction pipe ports 11*a*, 11*b* and 11*c*, 11*d*, respectively.

Accordingly, when the fuel from the fuel injection valve nozzles 22*a*, 22*b*, 22*c* and 22*d* collides against the inner walls of the ring vibrators 21*a* and 21*b* of such structure, it is instantly atomized, whereupon it is carried by the suction air so as to be uniformly imbibed into the respective cylinders.

Figure 3:
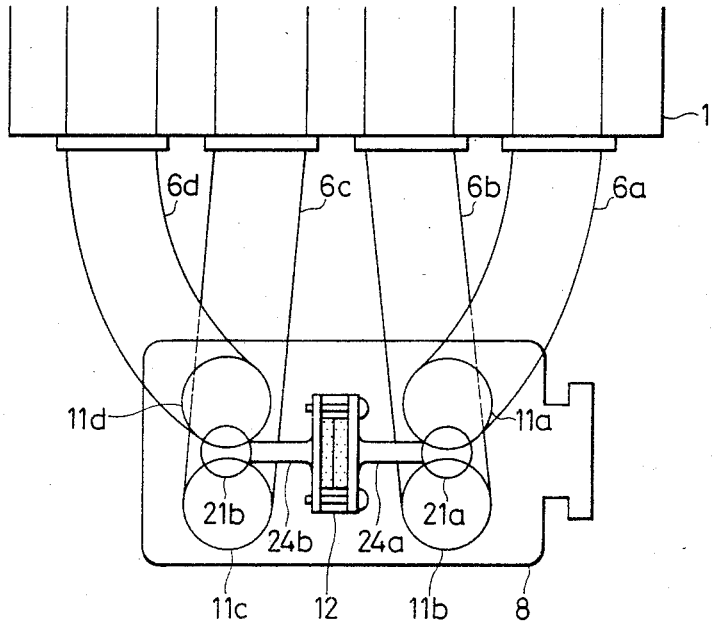
FIG. 3 is a view showing another example of the arrangement of the ring vibrators installed in the suction pipe.

FIG. 3 is a sectional view showing an embodiment of the mounting structure of the ring vibrators in the case where the arrayal of the suction pipe ports is not series. The suction pipe ports 11*a*, 11*b* and 11*c*, 11*d* are respectively arranged in parallel, and the ultrasonic vibrator 12 is located at the intermediate position between the two rows of the suction pipe ports 11*a*, 11*b* and 11*c*, 11*d*. Moreover, vibrator horns 24*a* and 24*b* do not enter the suction pipe ports, so that the crosssectional areas of the respective suction pipes 6*a*, 6*b*, 6*c* and 6*d* for passing the air become equal.

Next, there will be explained a method of equally introducing fuel to the ring vibrators 21*a* and 21*b*.

Figure 4:
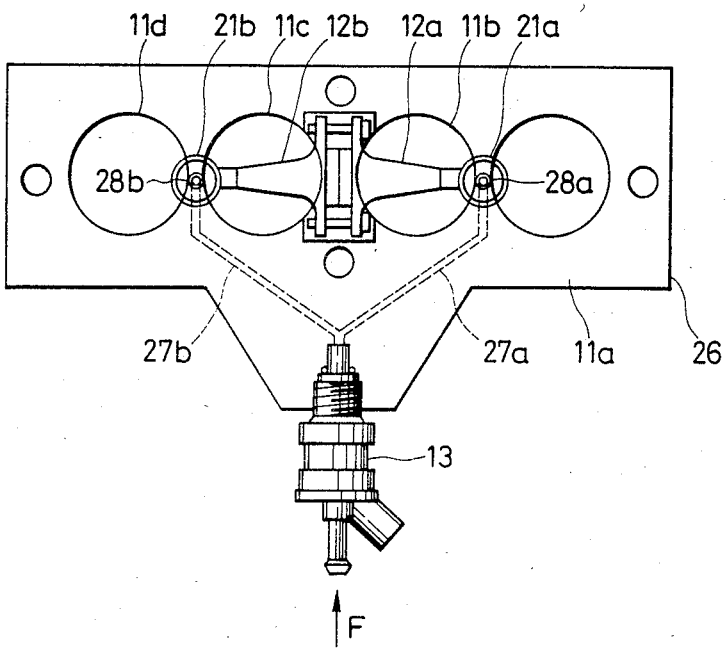
FIG. 4 is a view showing a ring vibrator mounting structure to which a fuel measuring system is added.

FIG. 4 shows a practicable embodiment therefor. The fuel F injected from the injection valve 13 passes through fuel pipes 27*a* and 27*b* to reach nozzles 28*a* and 28*b*, and it is injected toward the inner walls or outer walls of the ring vibrators 21*a* and 21*b*, thereby to be atomized. Here, the ring vibrators 21*a* and 21*b* are respectively located intermediately between the suction pipe ports 11*a* and 11*b* and those 11*c* and 11*d*. Besides, both the nozzles 28*a* and 28*b* are bifurcated over the respective ring vibrators 21*a* and 21*b*, and the nozzle positions are selected so that the fuel may be injected into the respective suction pipe ports. In this case, the respective bifurcate nozzles should desirably be constructed so that the fuel injected therefrom may collide against the upper ends of the ring vibrators 21*a* and 21*b* or against somewhat lower positions.

Figure 5:
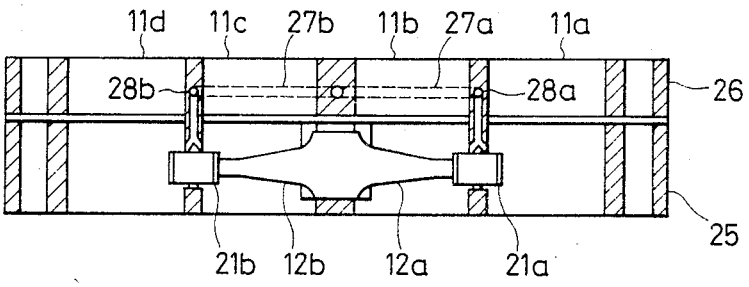
FIG. 5 is a vertical sectional view corresponding to FIG. 4.

FIG. 5 is a vertical sectional view of the portions in FIG. 4, showing the details of a spacer 25 for disposing ultrasonic vibrators 12*a*, 12*b* and a fuel passage plate 26 for measuring the fuel and injecting it for collision against the ring vibrators 21*a*, 21*b*. When the ultrasonic vibrators 12*a*, 12*b* are installed in the suction pipe portion as illustrated in FIGS. 4 and 5, it is possible to realize an atomizer for a four-cylinder engine, of which enhancement in power and a low fuel cost can be expected.

Figure 6:
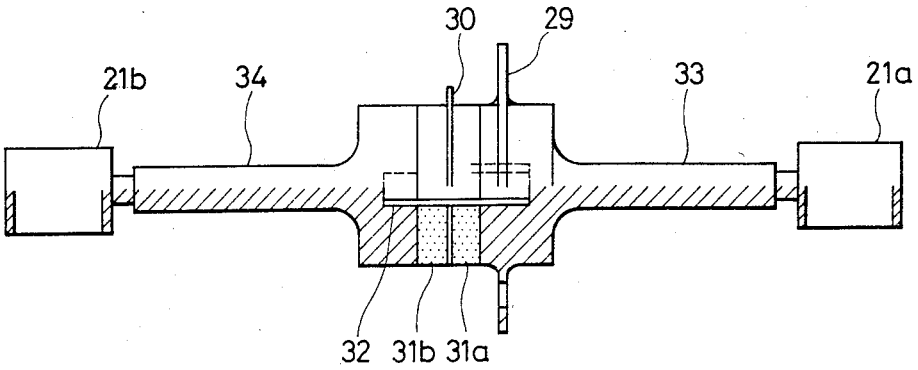
FIG. 6 is a view showing an example of the structure of the ring vibrators.

Next, the setup of the ultrasonic vibrator will be explained. FIG. 6 is a view showing an embodiment of the practicable setup thereof. In FIG. 6, electromechanical transducers 31*a* and 31*b* constructed of electrostrictive elements or magnetostrictive elements are respectively fastened to horns 33 and 34 by a bolt 32 with an anode 30 held therebetween. One horn 33 is provided with a flange 29 for fixation. The ring vibrators 21*a* and 21*b* are fixed to the distal ends of the respective horns 33 and 34 by silver brazing or welding in such a manner that their end faces are coplanar. The ultrasonic vibrator of such structure is fixed to the suction pipe by the flange 29, and a drive signal is applied across the flange 29 as a cathode and the anode 30.

Figure 7:
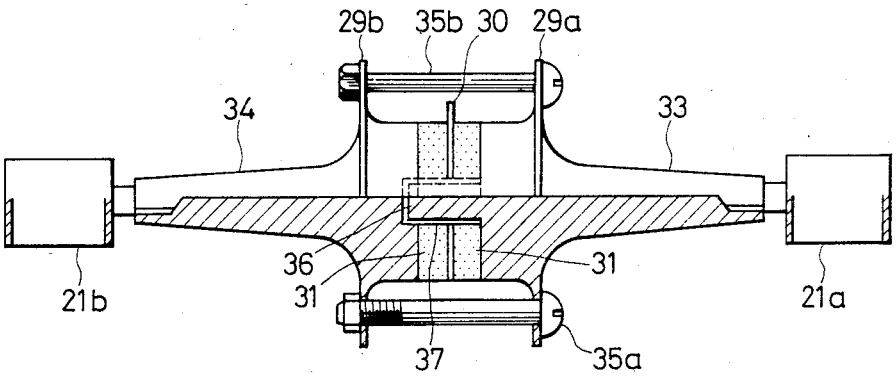
FIG. 7 is a view showing another example of the structure of the ring vibrators.

FIG. 7 is a view showing another embodiment of the ultrasonic vibrator. The electromechanical transducers 31*a*, 31*b* and the anode 30 are held between horns 33 and 34 having independent flanges 29*a* and 29*b*, and are clamped and fixed by bolts 35*a* and 35*b*. The ring vibrators 21*a* and 21*b* are respectively fixed to the distal ends of the horns 33 and 34 by screws or welding. Here, a stay 36 is provided centrally. This stay 36 is unitary with the horn 33, and is provided as a guide for bringing the center axes of the transducers 31*a*, 31*b*, anode 30 and horns 33, 34 into agreement in case of assembling the ultrasonic vibrator. An insulator 37 (synthetic resin) is packed between the transducers 31*a*, 31*b* and the stay 36.

Now, the shape of the horn of the ultrasonic vibrator will be described in detail.

Figure 8A:
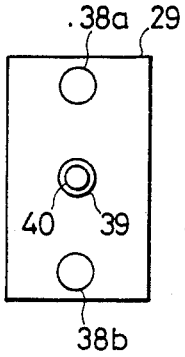
FIGS. 8(a)–8(c) are views showing an example of the structure of a horn.
Figure 8B:
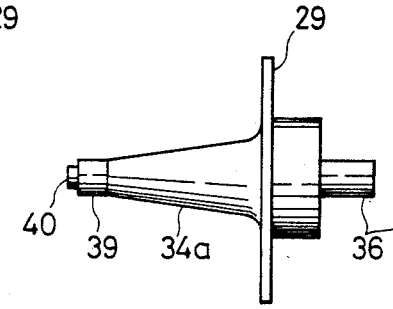
Figure 8C:
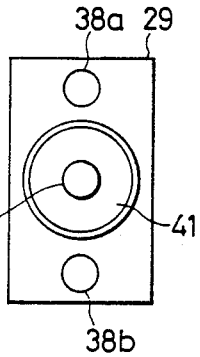
Figure 9:
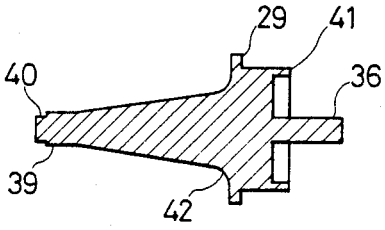
FIG. 9 is a vertical sectional view corresponding to FIG. 8(b)

FIGS. 8(a)–8(c) show a practicable embodiment thereof. FIG. 8(a) is a view of the horn 34 seen from its front. The flange 29 is oblong, and has bolt holes 38*a* and 38*b*. In addition, the distal end of the horn 34 has a parallel portion 39 and a spigot joint boss 40 for fixing the ring vibrator 21*a* or 21*b*. On the other hand, FIG. 8(c) is a view of the horn 34 seen from its rear. A groove 41 is provided concentrically with the stay 36 so that, in bringing the electromechanical transducers 31*a* and 31*b* (refer to FIG. 7) into close contact, the center axes thereof may be prevented from deviating. FIG. 8(b) is a view of the horn 34 seen from its side. Besides, FIG. 9 is a sectional view of the horn 34 shown in FIG. 8(a). The joint part of a horn portion 34*a* with the flange 29 is rounded as indicated at numeral 42.

Figure 10A:
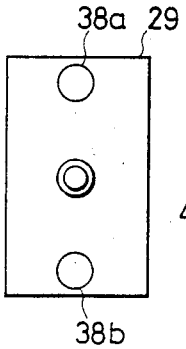
FIGS. 10(a)–10(c) are views showing another example of the structure of the horn.
Figure 10B:
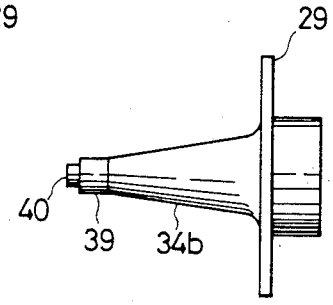
Figure 10C:
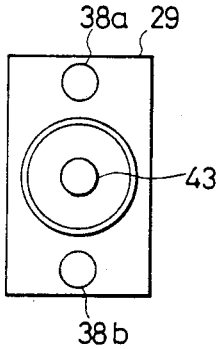
Figure 11:
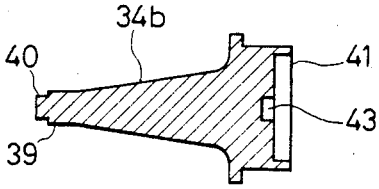
FIG. 11 is a vertical sectional view corresponding to FIG. 10(b)

FIGS. 10(a)–10(c) show the horn 34 of a structure which is very similar to the structure illustrated in FIGS. 8(a)–8(c), but from which the stay 36 is removed. FIG. 11 is a sectional view of the horn 34 shown in FIGS. 10(a)–10(c). A recess 43 which is somewhat larger in diameter than the stay 36 shown in FIGS. 8(b) and 8(c) is provided in the groove 41. Such recesses 43 function as spigot joints in the case where the two electromechanical transducers (not shown) are held between the horns as shown in FIGS. 10(a)–10(c) and are unitarily assembled therewith.

Figure 12A:
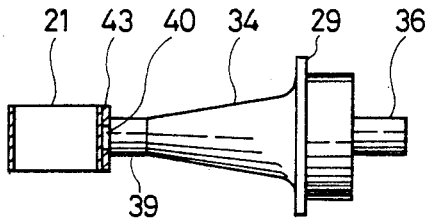
FIGS. 12(a) and 12(b) are a sectional view and a plan view, respectively, showing a structure for connecting the ring vibrator and the horn.
Figure 12B:
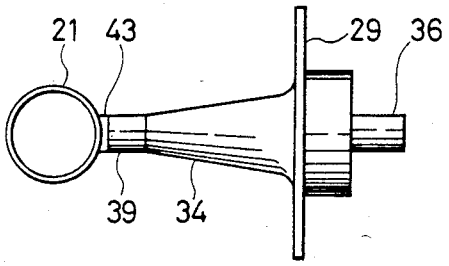

FIG. 12(a) is a view showing a section in the case where the ring vibrator 21 has been added to the horn 34. A stiffening plate 43 is pressed in the spigot joint boss 40 located at the distal end of the horn 34, and it is fixed to the ring vibrator 21 by silver brazing or welding. FIG. 12(b) is a view of the horn 34 having the ring vibrator 21 as seen from above. The ring vibrator 21 is fastened so that its center axis may orthogonally intersect the center axis of the horn 34.

Figure 13A:
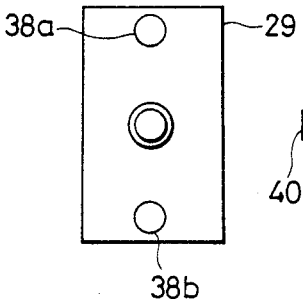
FIGS. 13(a)–13(c) are views showing still another example of the structure of the horn.
Figure 13B:
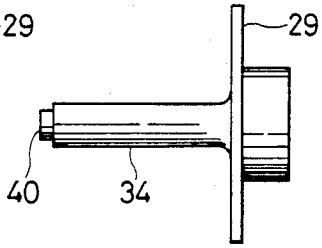
Figure 13C:
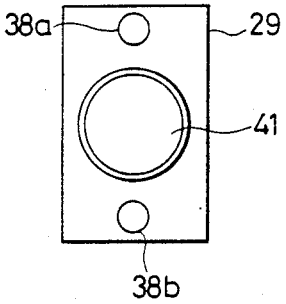
Figure 14:
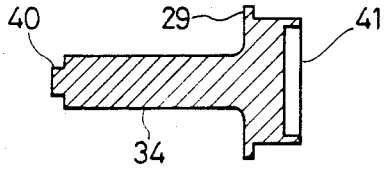
FIG. 14 is a vertical sectional view corresponding to FIG. 13(b)

FIGS. 13(a)–13(c) are views showing another embodiment on the horn shape, in which FIG. 13(a) is a front view of the horn 34, FIG. 13(b) is a side view thereof and FIG. 13(c) is a rear view thereof. In order to facilitate machining, the horn 34 is put into the shape of a circular cylinder. FIG. 14 shows a sectional view of the circular cylindrical horn 34 illustrated in FIGS. 13(a)–13(c).

Figure 15:
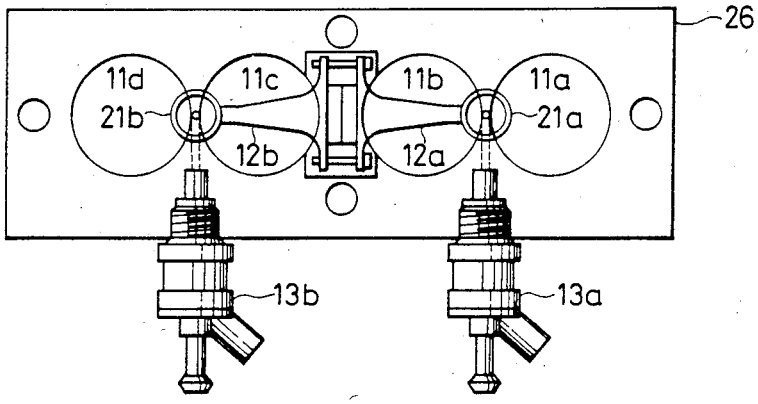
FIG. 15 is an arrangement view of essential portions showing a fourth embodiment of the present invention in which two fuel injection valves are installed.
Figure 16:
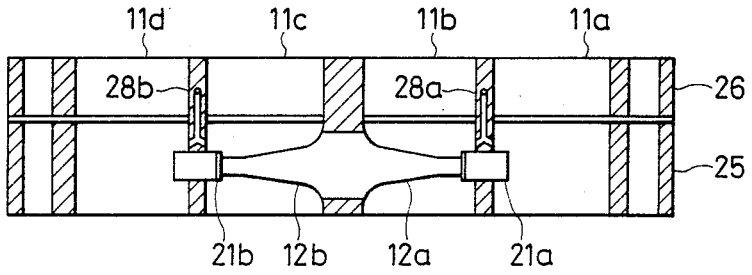
FIG. 16 is a sectional view corresponding to FIG. 16.
Figure 17:
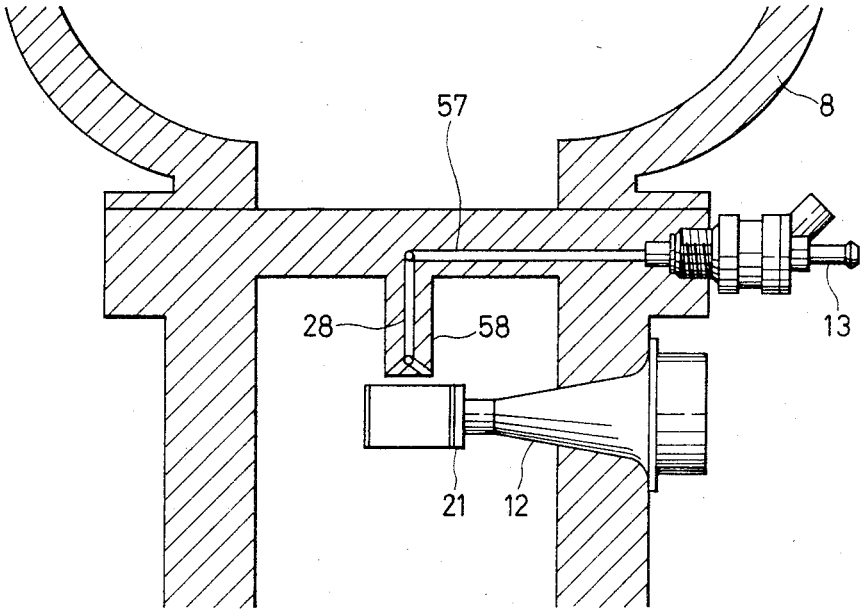
FIG. 17 is an enlarged view of a part in FIG. 16.

FIGS. 15 and 16 are views showing another embodiment of and near the suction pipe furnished with two injection valves. The two injection valves 13*a* and 13*b* are mounted on the fuel passage plate 26, and the fore ends of the respective injection valves 13*a* and 13*b* inject fuel from nozzle portions 28*a* and 28*b* to the inner walls of the ring vibrators 21*a* and 21*b*. With this structure, the fuel injection is executed in time with the suction stroke of the engine. FIG. 16 is a sectional view corresponding to FIG. 15. The vibrators 12*a* and 12*b* are received in the spacer 25, and the nozzles 28 suspend from the fuel passage plate 26 on the upper stream side to the centers of the ring vibrators 21*a* and 21*b*. FIG. 17 is a more enlarged view corresponding to FIG. 16. The fuel injected from the injection valve 13 passes through a passage 57 and reaches the nozzle portion 28, and it is injected to the corresponding ring vibrator 21 from an extreme end 58 which is formed smaller in bore than the fuel passage 57. Thus, the quantities of fuel injection are equalized.

Figure 18:
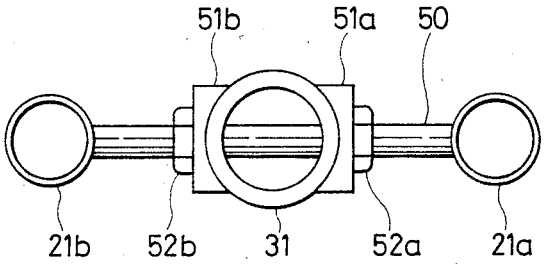
FIG. 18 is a view showing another example of the ring vibrators.
Figure 19:
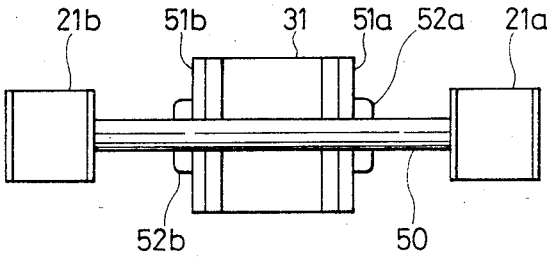
FIG. 19 is a sectional view corresponding to FIG. 19.

FIGS. 18 and 19 are views showing an embodiment in the case where the two ring vibrators 21*a* and 21*b* are excited by a single ring-shaped ultrasonic vibrator 31. A horn 50 in the shape of a circular cylinder is arranged so as to penetrate the side walls of the ring-shaped vibrator 31, and it is fastened to the ring-shaped ultrasonic vibrator 31 through stiffening plates 51*a* and 51*b* by nuts 52*a* and 52*b*. At both the ends of the horn 50, the ring vibrators 21*a* and 21*b* are fixed by welding. Since, in this case, the ring-shaped ultrasonic vibrator 31 vibrates in the radial direction thereof, the vibrations are propagated to the circular cylindrical horn 50 through the stiffening plates 51*a* and 51*b* and are transmitted to the ring vibrators 21*a* and 21*b* as longitudinal vibrations. As compared with the Langevin type vibrator mentioned before, such arrangement has the advantage that the plane of vibrations can be set as the whole surface in the circumferential direction.

What we claim is:

1. In a fuel supply system of an automobile engine, a multi-cylinder fuel atomizer comprising an electromechanical transducer disposed between a concentrated cylinder arranged in a suction passage and respective suction pipes independently branched from said concentrated cylinder to corresponding cylinders, a pair of ring vibrators, a pair of horns having the ring vibrators at the distal ends thereof, the other ends of the horns tightly contacting said electromechanical transducer such that said vibrators are partly exposed to said suction pipes, and a fuel injector arranged upstream of said electromechanical transducer to inject fuel to said vibrators.

2. A multi-cylinder fuel atomizer for automobiles as defined in claim 1, wherein the pair of ring vibrators are arranged symmetrically with respect to said electromechanical transducer.

3. A multi-cylinder fuel atomizer for automobiles as defined in claim 1, wherein said ring vibrators fixed to said electromechanical transducer are so arranged that theirs center agrees with a central position of a spacing between suction ports of said suction pipes.

4. A multi-cylinder fuel atomizer for automobiles as defined in claim 1, wherein said fuel injector includes a fuel distribution nozzle, a front end of which is arranged in proximity to a ring portion of said ring vibrators.

5. A multi-cylinder fuel atomizer for automobiles as defined in claim 1, wherein said fuel injector includes a fuel distribution nozzle, which is bifurcated over said ring vibrators, and bifurcate nozzle positions are so selected that the fuel is injected into respective suction ports of said suction pipes.

6. A multi-cylinder fuel atomizer for automobiles as defined in claim 1, wherein said fuel injector includes at least two fuel injection valves, which are arranged in a fuel passage, and front ends of the respective injection valves are so constructed that the fuel is injected to an inner wall of said ring vibrators so as to extend inwards.

7. A multi-cylinder fuel atomizer for automobiles as defined in claim 1, wherein said electromechanical transducer is an ultrasonic vibrator.

8. In a fuel supply system of an automobile engine, a multi-cylinder fuel atomizer comprising ultrasonic vibrator means disposed between a concentrated cylinder arranged in a suction passage and respective suction pipes independently branched from said concentrated cylinder to corresponding cylinders and common to said suction pipes, a plurality of ring vibrators corresponding to said suction pipes, a plurality of horns corresponding to the number of ring vibrators, each said vibrator being fixed to distal ends of said horns, and said horns tightly contacting said ultrasonic vibrator means, said vibrators being partly exposed to the corresponding suction pipes, and a nozzle which branches a fuel passage from a fuel injection valve and which injects fuel to inner walls of said plurality of ring vibrators so as to atomize the fuel by vibrations of said ring vibrators.

9. A multi-cylinder fuel atomizer for automobiles as defined in claim 2, wherein said fuel injector includes a fuel distribution nozzle, a front end of which is arranged in proximity to a ring portion of said ring vibrators.

10. A multi-cylinder fuel atomizer for automobiles as defined in claim 2, wherein said fuel injector includes a fuel distribution nozzle, which is bifurcated over said ring vibrators, and bifurcate nozzle positions are so selected that the fuel is injected into respective suction ports of said suction pipes.

11. A multi-cylinder fuel atomizer for automobiles as defined in claim 2, wherein said electromechanical transducer is an ultrasonic vibrator.

12. A multi-cylinder fuel atomizer for automobiles as defined in claim 3, wherein said fuel injector includes a fuel distribution nozzle, a front end of which is arranged in proximity to a ring portion of said ring vibrators.

13. A multi-cylinder fuel atomizer for automobiles as defined in claim 3, wherein said fuel injector includes a fuel distribution nozzle, which is bifurcated over said ring vibrators, and bifurcate nozzle positions are so selected that the fuel is injected into respective suction ports of said suction pipes.

14. A multi-cylinder fuel atomizer for automobiles as defined in claim 3, wherein said electromechanical transducer is an ultrasonic vibrator.

* * * * *